US005144326A

United States Patent [19]

Christinsin

[11] Patent Number: 5,144,326

[45] Date of Patent: Sep. 1, 1992

[54] WHIP TILT ADAPTER

[76] Inventor: Alan S. Christinsin, 1201 Dawn Dr., Belleville, Ill. 60220

[21] Appl. No.: 612,384

[22] Filed: Nov. 14, 1990

[51] Int. Cl.[5] ..... H01Q 1/32

[52] U.S. Cl. ..... 343/715; 343/906; 343/888

[58] Field of Search ..... 343/715, 713, 906, 888, 343/878, 900, 711

[56] References Cited

U.S. PATENT DOCUMENTS

| | | | |
|---|---|---|---|
| 2,934,764 | 4/1960 | Noll et al. | 343/876 |
| 2,966,678 | 12/1960 | Harris | 343/879 |
| 2,979,720 | 4/1961 | Leonard | 343/805 |
| 4,055,845 | 10/1977 | Ladrick | 343/715 |
| 4,074,271 | 2/1978 | Sakuma | 343/715 |
| 4,101,897 | 7/1978 | Morrison | 343/715 |
| 4,109,251 | 8/1978 | MacDougall | 343/715 |
| 4,243,989 | 1/1981 | Piper | 343/715 |
| 4,625,213 | 11/1986 | Horn | 343/715 |
| 4,804,973 | 2/1989 | Ackman | 343/906 |
| 4,827,273 | 5/1989 | Friedberg et al. | 343/715 |
| 4,893,130 | 1/1990 | Metivier | 343/713 |
| 4,916,456 | 4/1990 | Shyu | 343/713 |

OTHER PUBLICATIONS

A. S. Christinsin, P.E., "ASOC HF Communications" (Dec. 1987).

A. S. Christinsin, P.E., "Using The Whip-Tilt Adapter (NVIS Adapter) In The Field" (Jan. 1990).

AFCCRP 100-2, No. 1-88, "We Tried It And It Worked, The Continuing Saga Of MRC-107/108 HF" (First Quarter, 1988).

*Primary Examiner*—Rolf Hille
*Assistant Examiner*—Hoanganh Le
*Attorney, Agent, or Firm*—Dickstein, Shapiro & Morin

[57] ABSTRACT

A whip-tilt adapter allows a whip antenna that is normally vertically polarized to be horizontally polarized for use in near vertical incidence skyway communication. The adapter has a vertical shaft for connection to an antenna mount or a bottom section of the antenna, a near-horizontal member having a port to connect to the antenna, and optionally a vertical port for an antenna connection.

2 Claims, 3 Drawing Sheets

FIG. 1
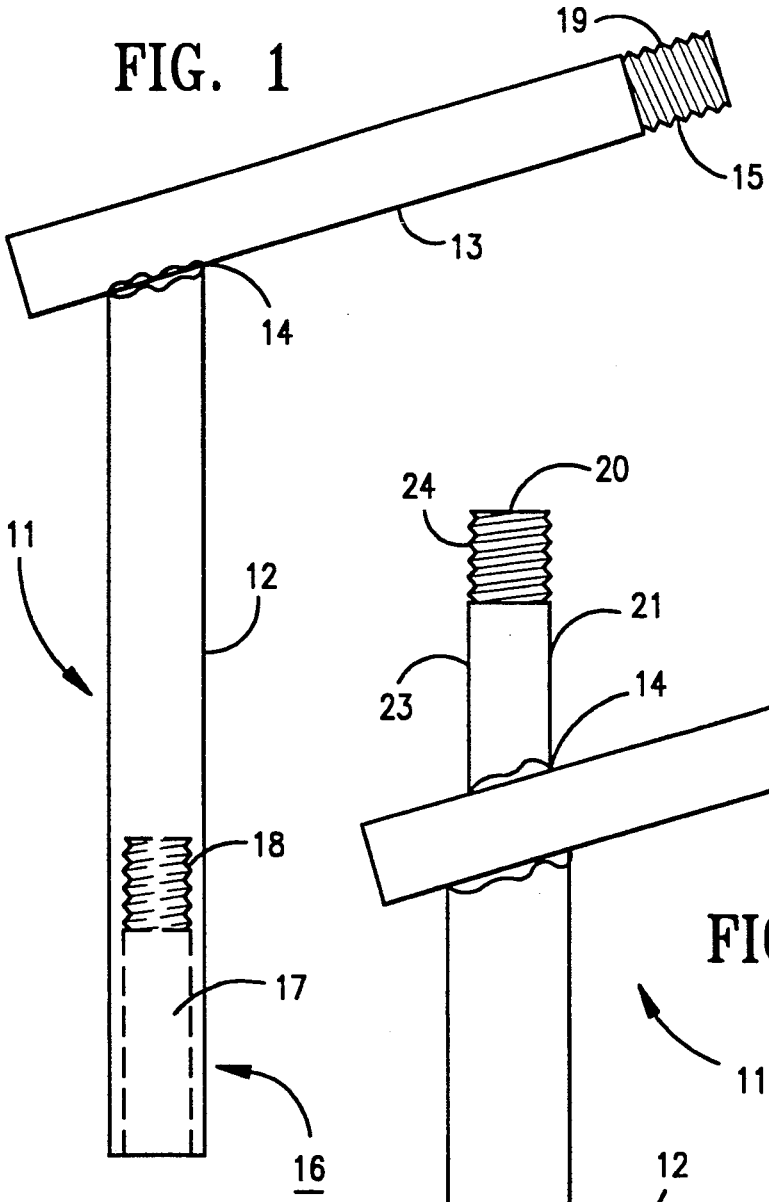
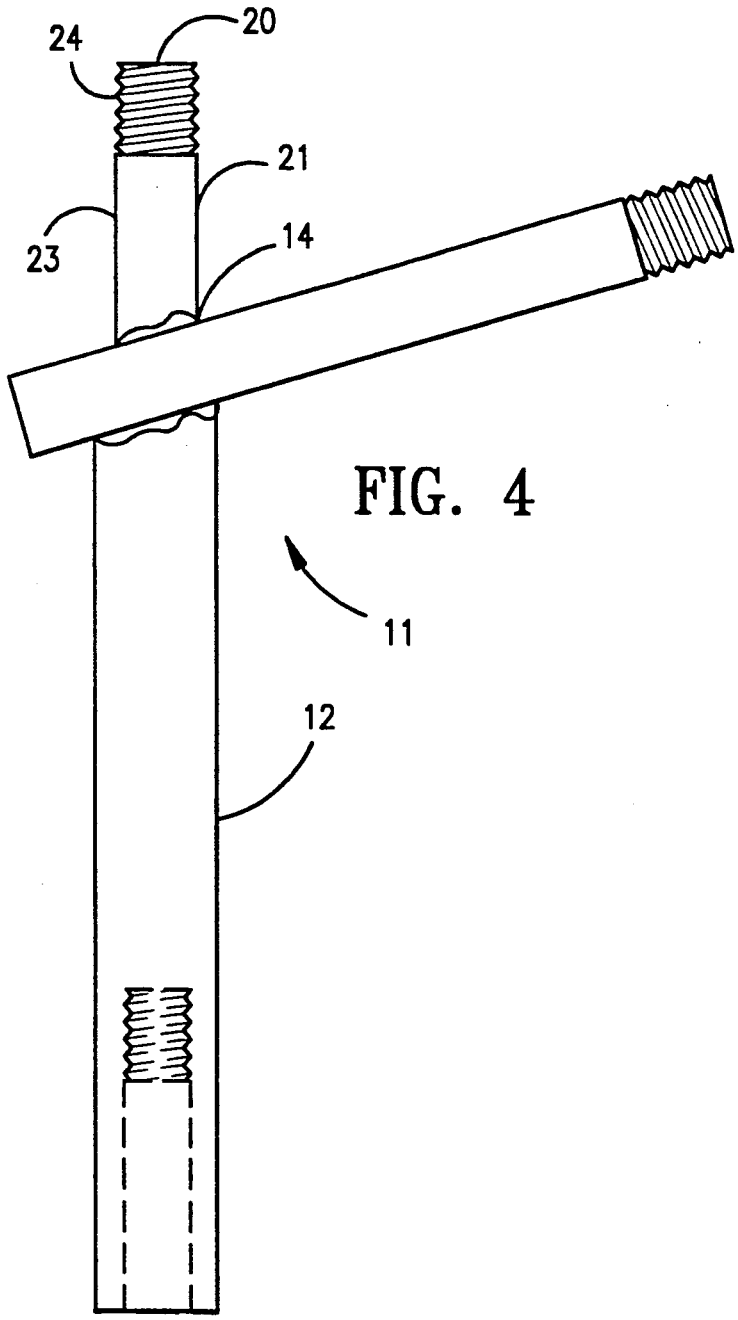
FIG. 4

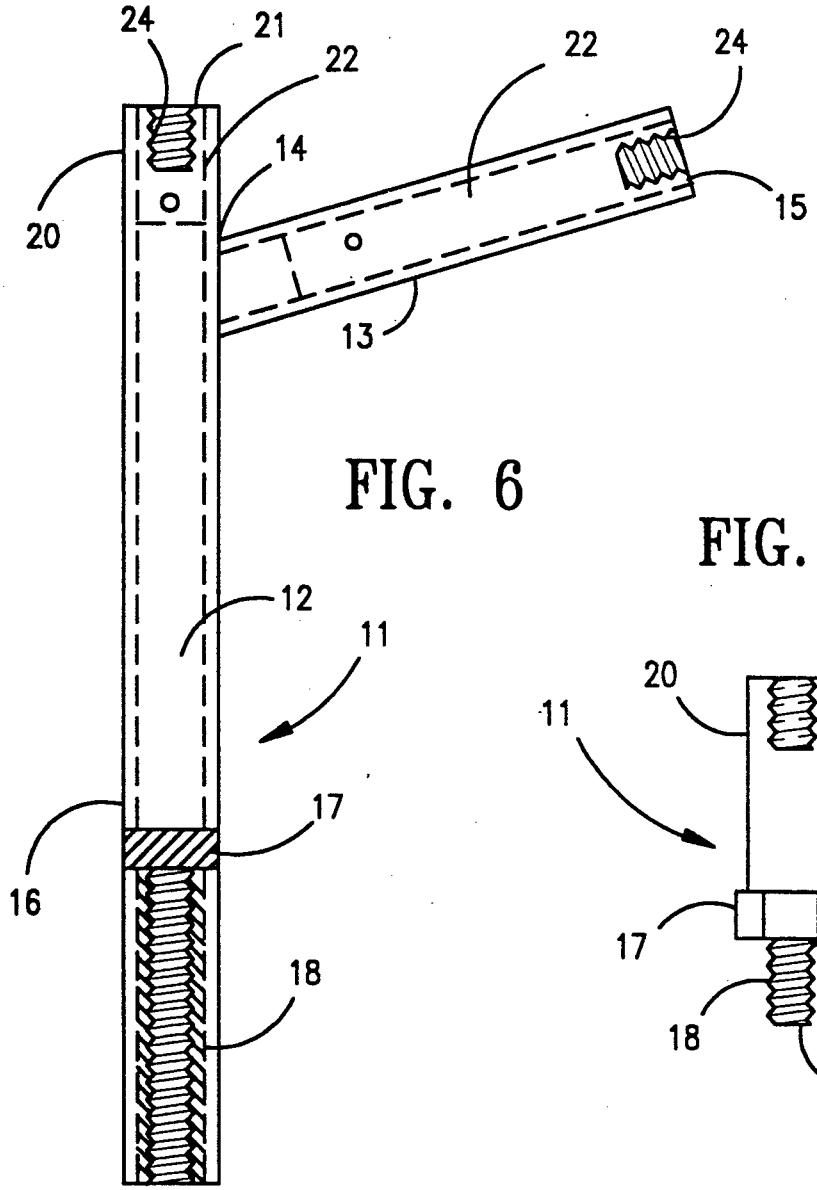
FIG. 6
FIG. 5
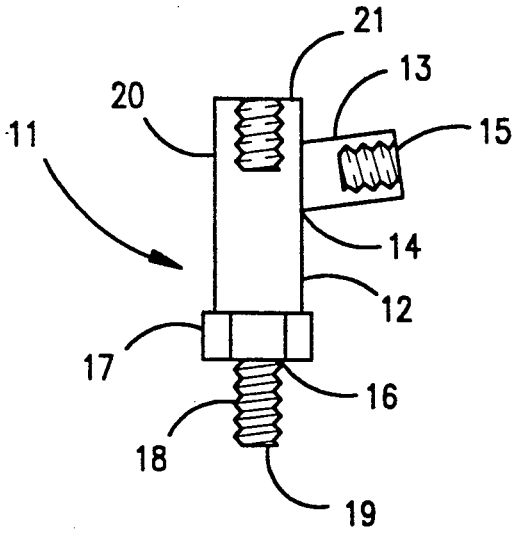
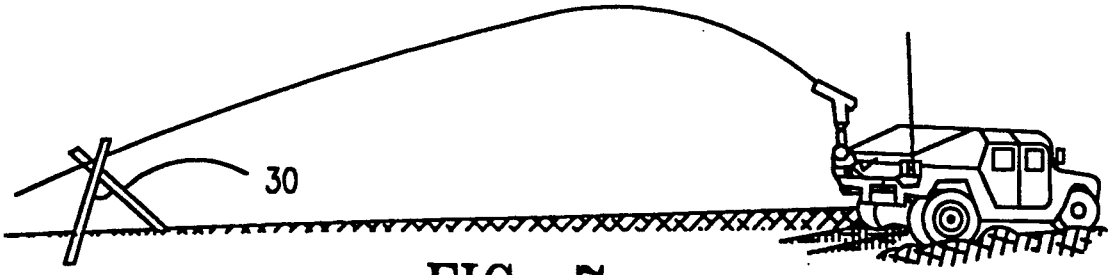
FIG. 7

WHIP TILT ADAPTER

BACKGROUND OF THE INVENTION

Most military vehicles that are employed with tactical units and provide and receive communications by high frequency (HF) radio, typically utilize tapered flexible vertical antennas called "whips". The most common whips consist of four 4 foot sections (16 foot whip) for use while the vehicle is moving, or eight 4 foot sections (32 foot whip) for use when the vehicle is stationary, referred to as "at-halt" operation. The sections are typically joined with threaded fittings. The bottom section has a threaded fitting for attachment to an antenna mount attached to a vehicle or shelter. The vertical orientation whip is practical for vehicle mounting and useful for short distance ground wave communications. However, certain intermediate distance communication requires that NVIS (near vertical incidence skywave) communication be employed. This involves refraction of the radio signals off the ionosphere at angles near 90° above the horizontal. Signals emitted at high vertical radiation angles are reflected/refracted from the ionosphere at acute angles and return to earth at short and medium distances with useable signal intensity. NVIS is particularly effective where the participating net stations are spread over geographical areas within approximately 300 miles of each other. For example, if HF radio stations operating on lower HF frequencies (2 to 14 MHz) radiate signals at angles between 90 degrees (directly overhead) to approximately 45 degrees, the signals will return to earth with a signal 300 miles (480 kilometers) of the transmitting station.

To produce adequate signal levels at these high angles, sending and receiving antennas should be horizontally polarized. The whip antenna, in its normal position, is vertically polarized, i.e., the electrostatic field is perpendicular to the Earth and the electromagnetic field is parallel to the Earth, thus producing low signal levels at high angles. The vertical radiation pattern of a vertical whip has the highest gain at angles below 45 degrees above the horizon. The antenna thus performs fairly well when used for ground wave communication (short distances, usually under 25 miles), but poorly at high radiation angles necessary for NVIS communication.

One method of providing some horizontal polarization for NVIS operation is to bend the whip from the vertical toward a horizontal position to the maximum extent possible. However, because the bottom whip sections are rigid and spring mounts (when used) are stiff, it is difficult to bend the lower sections of the whip to a near horizontal position where maximum current and radiation occurs.

Adjustable antennas for vehicles are known in the art. U.S. Pat. Nos. 4,109,251, 4,243,989, 4,827,273, 4,101,897, 4,055,845, and 4,074,271 each disclose an adjustable antenna mounted on a vehicle. The antennas used in the mountings disclosed in these patents are not whip antennas. Further, these types of adjustable antennas are bulky, expensive, and difficult to use. It would be impractical to use the types of antennas disclosed in the above-mentioned patents in place of the standard whip antenna.

U.S. Pat. Nos. 2,934,764, 2,979,729 and 4,625,213 each disclose mounts for antennas. The mounts hold an antenna to a surface in a fixed orientation, and do not provide for easy transition between vertical and horizontal polarization. Further, the disclosed mounts cannot readily be substituted for a mount on an existing whip antenna connection.

There is therefore a need to provide a method and simple and inexpensive device for changing the polarization of a whip antenna between vertical and horizontal without requiring replacement of the vehicle's existing whip or radio antenna coupler.

SUMMARY OF THE INVENTION

This need is met by an adapter to which a whip antenna can be fitted in a near-horizontal position, thereby producing horizontal polarization, or in a vertical position. The electrically conductive L-shaped adapter has a vertical shaft, a near-horizontal member, means for securing the vertical shaft to the mounting base or a bottom section of the whip antenna and a port for the upper portion of the whip antenna section in the near-horizontal member. The means for securing the vertical shaft to the base of the antenna, which is in turn secured to the antenna mount, are located at the lower end of the vertical shaft. The near-horizontal member is connected to the upper end of the vertical shaft. The whip antenna port is located at the end of the near-horizontal member distal from the vertical shaft. In other embodiments, a second whip port is located either at the end of the of the near-horizontal member proximal to the vertical member or at the upper end of the vertical shaft. The second port may be formed in either the near-horizontal member or vertical shaft or the port may be formed in a vertical post extending from the junction of the vertical shaft and near-horizontal member.

With this adapter, the antenna's polarization can be changed quickly and the vehicle's existing radio antenna coupler and whip can be used.

BRIEF DESCRIPTION OF THE DRAWINGS

FIG. 1 illustrates a first embodiment of the invention with a single port.

FIG. 4 illustrates a second embodiment of the invention with two antenna ports.

FIG. 5 illustrates a third embodiment of the invention with two antenna ports and a threaded stud for mounting.

FIG. 6 illustrates a fourth embodiment of the invention with two antenna ports and an alternate configuration for the ports and mounting means.

FIG. 7 illustrates the use of the adapter shown in the previous figures used with an antenna in an "at halt" position.

DETAILED DESCRIPTION

Figure 2:
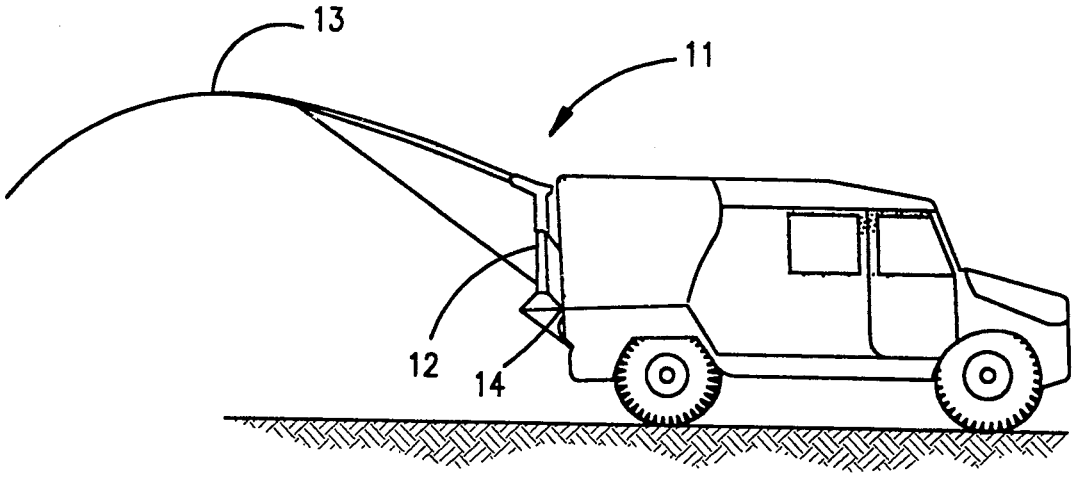
FIG. 2 illustrates the use of the adapter shown in FIG. 1 with a rear-tilt antenna.

A first embodiment of the invention is illustrated in FIG. 1. The whip tilt adapter 11 is attached to a whip, either between the bottom sections or between the whip and the antenna mount or between the whip sections. The mount may be stationary or mobile, e.g., on a shelter or a vehicle. The adapter has a vertical shaft 12 and a near-horizontal member 13, attached to the upper end 14 of the vertical shaft and distally terminating in a horizontal port 15. The vertical shaft includes a bore 17 at the lower end 16. The bore 17 has internal threads 18. The internal threads match the external threads at the top of a whip section or on the whip mount and thus vary with the specific thread configuration of antenna with which the adapter is used. The horizontal port 15 is formed with external threads 19 that are compatible with the threads of the bottom of the section of the whip being used.

Figure 3:
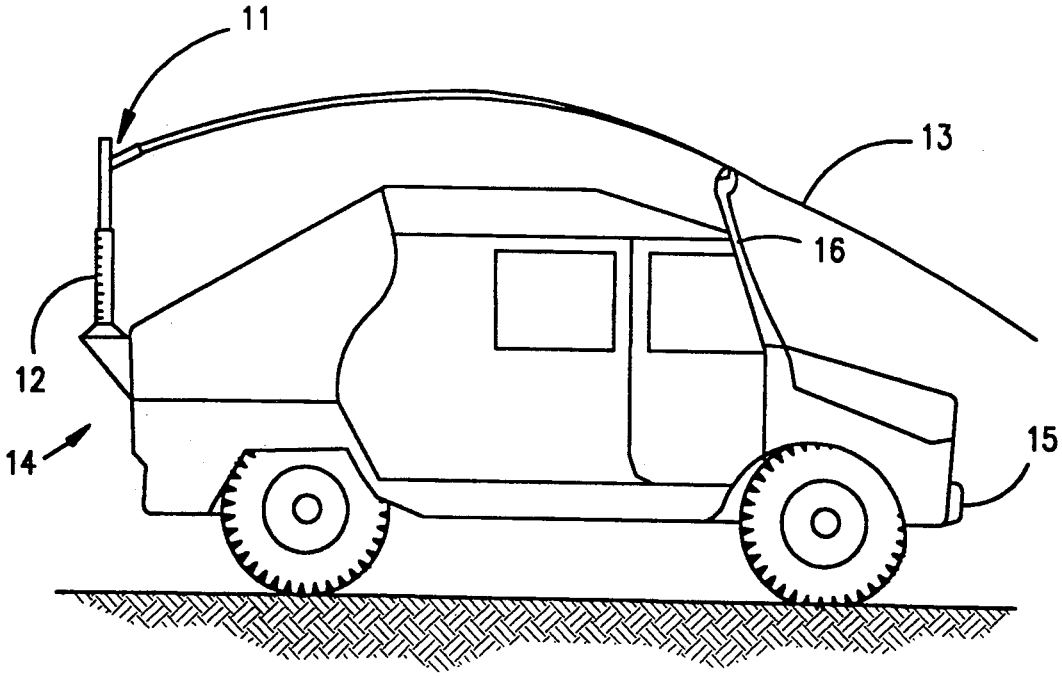
FIG. 3 illustrates the use of the adapter shown in FIG. 1 a forward-tilt antenna.

The lengths of the vertical shaft and near-horizontal member may vary. The lengths are generally determined by the type of vehicle with which the whip is to be used or other practical reasons. The lengths of the adapter's shaft and near-horizontal member must allow the whip to clear the vehicle, if the whip is tilted forward, and not drag the ground, if the whip is tilted towards the rear. FIG. 2 shows the use of the adapter for a rear tilt whip. The adapter 11 is mounted on an antenna mount 12 on the rear of the vehicle 14 with the whip 13 tilted away from the vehicle. FIG. 3 shows use of the adapter for a forward tilt whip. The adapter 11 is mounted on an antenna mount 12 at the rear of the vehicle 14 with the whip 13 tilted towards the front of the vehicle.

The angle formed between the near-horizontal member and the vertical member is not particularly critical and can be optimized for the user/vehicle antenna onto which the adapter will connect. Generally, the angles employed are between 0 and 45 degrees above the horizontal. If the angle is greater than 45 degrees above the horizontal, the antenna loses its ability to become horizontally polarized and NVIS reception becomes more difficult. Usually, angles between 20–25 degrees above the horizontal are preferred as they allow for optimal radiation/reception at NVIS angles and afford the best practical mountings of the antenna with respect to the shelter or vehicle.

The adapter is preferably formed of a conductive material such as aluminum, stainless steel or brass stock and can be formed of machined pieces welded together or from a single machined piece. Adapters from machined pieces are preferred simply because their manufacture is easier. By being electrically conductive, the adapter provides a radio frequency electrical connection between the whip sections that it joins. There is no discernable power loss due in the adapter. Alternatively, the adapter can be formed of poorly conductive or nonconductive material such as a high strength plastic. If the adapter is not formed by conductive material, then it will be necessary to add some type of electrical connectivity means for establishing a connection between the port and the antenna base.

Because the adapter is inserted into the antenna system at or near the base, there is an inherent low voltage (shock) potential even with transmitters with power levels up to 400 watts. The adapters may be insulated to prevent personnel from touching the conductive metal portion. The adapter may be insulated by encapsulating it in plastic, fiberglass, or other insulating material.

A second embodiment of the invention is illustrated in FIG. 4. In addition to the features described in the first embodiment, the adapter 11 has a second port 20 on the upper end 21 of a vertical post 23. The vertical post is attached to the juncture of the upper end 14 of the vertical shaft 12 and the near-horizontal member. The vertical port is formed with external threads 24 that ar compatible with the internal threads of the bottom of a section of the whip being used.

A third embodiment of the present invention is illustrated in FIG. 5. The adapter 11 of this embodiment is similar to that of the second embodiment, having a vertical shaft 12, a near-horizontal member 13 attached to the upper end 14 of the vertical shaft and distally terminating in a horizontal port 15. A vertical post 20 is attached to the upper end 14 of the vertical shaft. The vertical post terminates in a second port 21. However, this embodiment is configured for use with whips having externally threaded, formed fittings at the bottom ends of the whip sections. Therefore, the adapter also has an attachment fitting 17 connected to the lower end 16 of the vertical shaft. The attachment fitting has external threads 18 at its lower end 19. Similarly, both the horizontal and vertical ports are formed with internal threads that are compatible with the threads of the whip being used.

FIG. 6 illustrates a fourth embodiment of the invention. The adapter 11 of this embodiment has a hollow vertical shaft 12 and a hollow near-horizontal member 13 attached to the upper end 14 of the vertical shaft and distally terminating in a horizontal port 15. A vertical post 20 is also attached to the upper end of the vertical shaft and the post terminated in a vertical port 21. Both the horizontal port 15 and the vertical port 21 are formed by metal inserts 22 having internal threads 24. The inserts are (welded, threaded) into the near-horizontal member and vertical post. The vertical shaft includes an internally located metal plug 17 positioned near the lower end 16 of the shaft welded to a metal stud 18 running from the lower end of the shaft to the metal plug. The metal stud is threaded so that it is compatible with the threads of the whip being used, e.g., Smith base 16/12 foot Army whips. The plug and the stud provide additional stability.

In any of the one-port or two-port adapters, i.e., the four embodiments described above, there is no specific requirement for the ports to be either male or female other than to mate with a particular type/model of whip. Additionally, there is no requirement that the vertical shaft end in either male or female threads. Both are dependant on the type of user/vehicle antenna to which the adapter will connect. For example, the threads may be Edison or SAE threads which are compatible with AT-1011 32/16 foot fiberglass antennas used by the United States Marine Corps and Air Force and the AN/PRC-104 HF manpack radios, respectively.

The whip tilt adapter of the present invention has the ability to convert a whip from a vertically polarized antenna to a horizontally polarized antenna. To use the adapter, the adapter is first connected to the mating antenna base or whip section. The near-horizontal member is then pointed in the direction that the whip should lie and the whip is then connected to the horizontal port. As illustrated in FIG. 3, when using the adapter for a forward-tilt antenna it may be desirable to tie the end of the whip to the front bumper 15, the fording kit, the windshield 16 or other fixed points using nylon or other weather resistant, non-conductive rope or brackets. As illustrated in FIG. 2, when using the adapter for a rear-tilt antenna, it may be desirable to tie the whip to the two rear sides of the vehicle to prevent it from flaying when the vehicle is moving. If the 32 foot whip is being used "at halt," the whip can be held in place by a cradle 30, which also helps to relieve the strain of the long antenna due to gravitational forces. Use of the adapter in an "at halt" position is illustrated in FIG. 7.

Using a conventional, vertical whip antenna with the whip tilt adapter avoids using bulky, large, and mechanically difficult and time consuming solutions using adjustable wire antennas. Additionally, with respect to use on vehicles, the whip-tilt adapter allows the vehicle to function using near-vertical incidence with a physically flexible, electrically efficient, simple and inexpensive antenna.

What is claimed is:

1. A method of using a long flexible whip antenna, wherein said whip antenna has a first distal end and a second threaded end, and wherein said whip antenna is at least about 12 feet long, said method comprising the steps of:

A) providing a vehicle and an antenna base which is attached to said vehicle, said antenna base having a threaded upper end, said threaded upper end of said antenna base being compatible with said second threaded end of said whip antenna such that said second threaded end of said whip antenna is connectable to said threaded upper end of said antenna base;

B) providing an adapter which includes:

a) a vertical shaft having a lower threaded end and an upper end, said lower threaded end of said vertical shaft being compatible with said threaded upper end of said base such that both said second threaded end of said whip antenna and said lower threaded end of said vertical shaft are connectable to said threaded upper end of said antenna base;

b) whip antenna support means for selectively supporting said long flexible whip antenna in a near-horizontal position relative to said vehicle and for supporting said flexible whip antenna in a generally vertical position relative to said vehicle, said whip antenna support means being connected to said upper end of said vertical shaft, said whip antenna support means comprising an elongated support member for extending laterally from said upper end of said vertical shaft, said elongated support member having a threaded first end which is distal from said upper end of said vertical shaft, said threaded first end of said elongated support member being compatible with said second threaded end of said whip antenna such that said second threaded end of said whip antenna is connectable to said threaded first end of said elongated support member; and c) means for establishing electrical connectivity between said threaded first end of said elongated support member and said antenna base;

C) attaching said adapter to said antenna base by connecting said lower threaded end of said vertical shaft to said threaded upper end of said antenna base;

D) while said adapter is attached to said antenna base, attaching said long flexible whip antenna to said adapter by connecting said second threaded end of said flexible whip antenna to said threaded first end of said elongated support member of said adapter;

E) using said elongated support member of said adapter to support said whip antenna in said near-horizontal position relative to said vehicle;

F) while said whip antenna is supported in said near-horizontal position by said elongated support member, performing NVIS radio wave propagation by propagating HF radio waves from said whip antenna;

G) while said adapter is attached to said antenna base, using said whip antenna support means to support said whip antenna in said generally vertical position; and H) while said whip antenna is supported in said generally vertical position by said antenna support means of said adapter, performing radio wave propagation by propagating radio waves from said whip antenna.

2. The method of claim 1, wherein said whip antenna support means includes a vertical post, and wherein said method further comprises the steps of disconnecting said antenna from said elongated support member and connecting said antenna to said vertical post.

* * * * *